US007994989B2

(12) United States Patent
Young

(10) Patent No.: US 7,994,989 B2
(45) Date of Patent: Aug. 9, 2011

(54) HANDHELD DEVICE WITH SWITCHABLE SIGNAL RECEIVING MODES

(75) Inventor: Sea-Weng Young, Taipei County (TW)

(73) Assignee: Inventec Appliances Corp., Taipei (TW)

( * ) Notice: Subject to any disclaimer, the term of this patent is extended or adjusted under 35 U.S.C. 154(b) by 309 days.

(21) Appl. No.: 12/418,171

(22) Filed: Apr. 3, 2009

(65) Prior Publication Data

US 2009/0256761 A1 Oct. 15, 2009

(30) Foreign Application Priority Data

Apr. 9, 2008 (TW) ..... 97112918 A

(51) Int. Cl.
*H01Q 1/24* (2006.01)
*H01Q 1/10* (2006.01)

(52) U.S. Cl. ..... 343/702; 343/901

(58) Field of Classification Search ..... 343/702, 343/900, 901, 876; 455/73, 11.1, 13.3, 78, 455/456.1

See application file for complete search history.

(56) References Cited

U.S. PATENT DOCUMENTS 6,054,959 A * 4/2000 Amos et al. ..... 343/702
6,865,376 B2 * 3/2005 Forrester ..... 455/73

* cited by examiner

*Primary Examiner* — Hoang V Nguyen
(74) *Attorney, Agent, or Firm* — Muncy, Geissler, Olds & Lowe, PLLC

(57) ABSTRACT

A handheld device with switchable signal receiving modes includes a telescopic antenna, a telecommunication transceiver module, a satellite signal module, and a switch circuit. Upon receiving a switch signal, the switch circuit couples the telescopic antenna to the telecommunication transceiver module, and adjusts the telescopic antenna to a first length, so that the telecommunication transceiver module transmits and receives a signal of a first frequency, or the switch circuit adjusts the telescopic antenna to a second length, so that the telecommunication transceiver module transmits and receives a signal of a second frequency. Alternatively, the switch circuit couples the telescopic antenna to the satellite signal module, and adjusts the telescopic antenna to the second length, so that the satellite signal module receives a satellite signal. Thereby, the handheld device can receive signals of various frequencies via one antenna, so that different functional modules transmit and receive signals of different frequencies.

12 Claims, 5 Drawing Sheets

HANDHELD DEVICE WITH SWITCHABLE SIGNAL RECEIVING MODES

CROSS-REFERENCE TO RELATED APPLICATION

This application claims the benefit of Taiwan Patent Application No. 097112918, filed on Apr. 9, 2008, which is hereby incorporated by reference for all purposes as if fully set forth herein.

BACKGROUND OF THE INVENTION

1. Field of the Invention

The present invention relates to a handheld device, and more particularly to a handheld device with switchable signal receiving modes.

2. Related Art

With the rapid technological progress and vigorous competition, business trip is rapidly becoming common. In addition, people have taken mobile phones along with them even on a tour in holidays. However, generally, conventional mobile phones are merely adapted to one frequency. Considering users having several phone numbers, the current mobile phone is configured with a dual module that can be inserted with two SIM cards, and is further equipped with a composite antenna therein. Thus, when different phone numbers are used, a telecommunication signal of an appropriate frequency corresponding to a certain phone number can be transmitted and received via the composite antenna.

Moreover, in order to enhance the functions of the mobile phone, some mobile phones are equipped with a global positioning system (GPS) or a network TV module, so that the users can perform the satellite positioning operation or enjoy network TV.

However, the prior art has some difficulties that are difficult to overcome.

Firstly, a mobile phone user may go abroad in a certain business trip, but a transmission frequency of the mobile phone is generally a fixed single frequency, and at the best circumstance, the mobile phone is equipped with a composite antenna to use together with a dual module. Unfortunately, the mobile phone may not meet the requirements of the frequencies of the telecommunication signals adopted by a local telecommunication system, i.e., the mobile phone cannot work. Even when the user has got a local telecommunication phone number, the user still needs a mobile phone conforming to the local telecommunication system.

Secondly, although some mobile phones are equipped with the GPS, such mobile phones still need to be equipped with an additional dedicated antenna for transmitting and receiving satellite signals, which further occupies some space within the mobile phone.

Thirdly, a mobile phone user may be a subscriber of the satellite TV, and the mobile phone generally transfers TV images over the telecommunication network. However, due to the different frequencies of the transferred signals, the telecommunication network cannot be combined with the satellite system, so an additional antenna for receiving satellite signals needs to be configured. Actually, considering the cost and phone volume, most manufacturers do not provide a mobile phone with satellite TV, which restricts the functions of the mobile phone.

SUMMARY OF THE INVENTION

In view of the above, the present invention is directed to a handheld device, which includes an antenna that can transmit and receive signals of various different frequencies, so that different functional modules within the handheld device can transmit and receive corresponding signals.

In order to solve the above problem, a technical means of the present invention is to provide a handheld device with switchable signal receiving modes. The handheld device includes a telescopic antenna, a telecommunication transceiver module, a satellite signal module, and a switch circuit. The switch circuit is coupled to the telescopic antenna, the telecommunication transceiver module, and the satellite signal module.

According to a switch signal, the switch circuit electrically couples the telescopic antenna to the telecommunication transceiver module, and adjusts the telescopic antenna to a first length for the telecommunication transceiver module to transmit and receive a signal of a first frequency, or adjusts the telescopic antenna to a second length for the telecommunication transceiver module to transmit and receive a signal of a second frequency. Alternatively, the switch circuit electrically couples the telescopic antenna to the satellite signal module according to the switch signal, and adjusts the telescopic antenna to the second length for the satellite signal module to receive a satellite signal.

In the handheld device with switchable signal receiving modes of the present invention, the telescopic antenna is a multi-segment antenna.

In the handheld device with switchable signal receiving modes of the present invention, the switch circuit electrically couples the telescopic antenna to the telecommunication transceiver module according to the switch signal, and adjusts the telescopic antenna to a third length for the telecommunication transceiver module to transmit and receive a signal of a third frequency.

The present invention can achieve efficacies that cannot be achieved by the prior art.

Firstly, with the design of the telescopic antenna, the handheld device can receive signals of various frequencies for the telecommunication transceiver module to transmit and receive signals of different frequencies, so that the handheld device can adjust the telescopic antenna to cater to the frequencies of the telecommunication signals adopted by a local telecommunication system, thereby carrying out communications in conjunction with local telecommunication phone numbers.

Secondly, all the functional modules of the handheld device can transmit and receive signals of different frequencies merely through extending and retracting the telescopic antenna, so that only a single antenna is required for the whole handheld device, thereby saving the inner space of the handheld device.

Thirdly, when the telescopic antenna is adjusted to the second length, it can be adapted to receive telecommunication signals of higher frequencies and satellite signals. With an input device and the switch circuit, a user can selectively switch between the satellite signal module and the telecommunication transceiver module to enable one of them to be electrically coupled to the telescopic antenna, thereby acquiring corresponding telecommunication signals or satellite signals. Moreover, the satellite signal module can be incorporated with functions of the satellite TV and the GPS, thereby enabling the subscribers of the satellite TV to enjoy TV programs without paying additional telecommunication fees.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

In order to further understand the aspects, construction features, and functions of the present invention, a detailed illustration is made below with reference to the related embodiments and the drawings.

Figure 1:
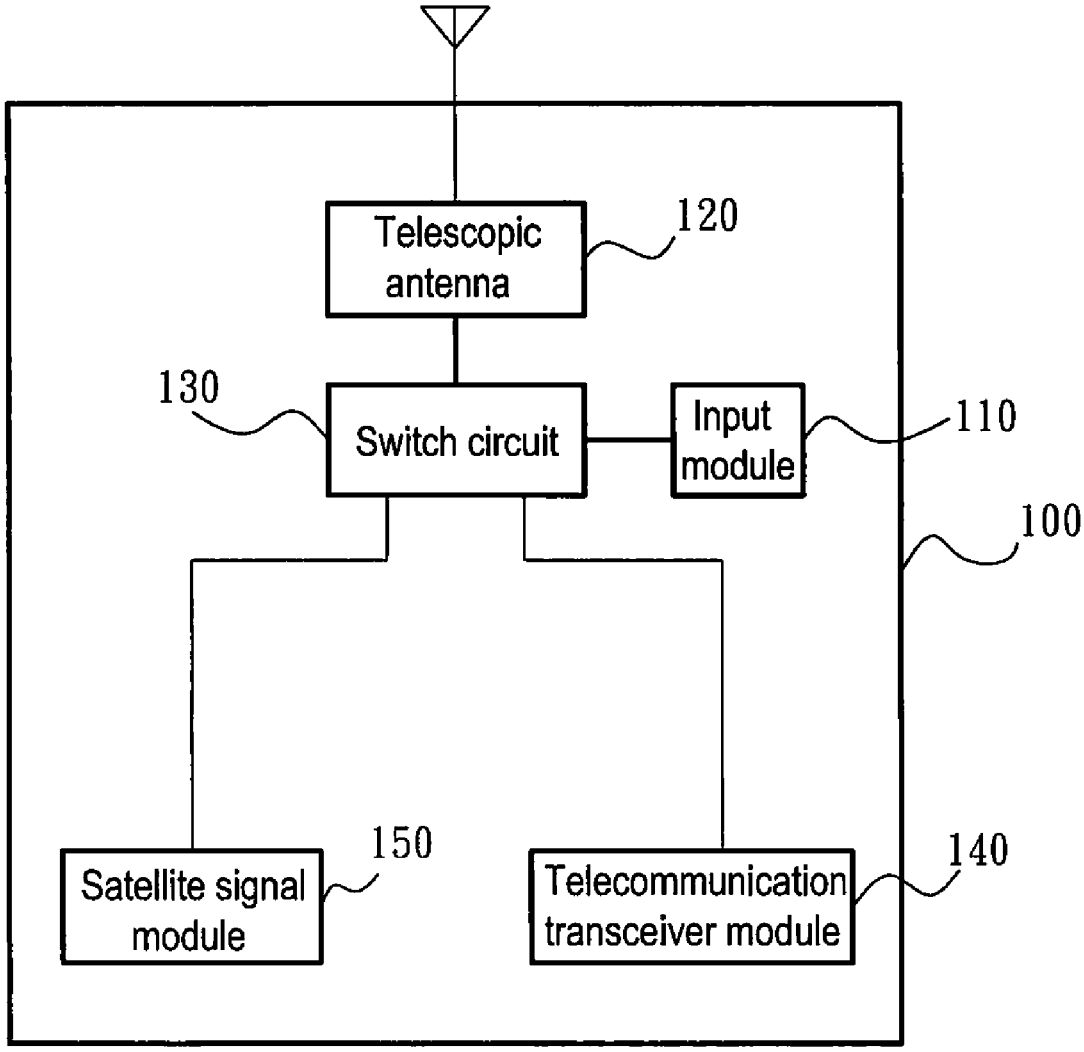
FIG. 1 is a schematic view of an internal structure of a handheld device according to an embodiment of the present invention.

FIG. 1 is a schematic view of an internal structure of a handheld device according to an embodiment of the present invention. Referring to FIG. 1, a handheld device 100 includes a telescopic antenna 120, a telecommunication transceiver module 140, a satellite signal module 150, a switch circuit 130, and an input module 110.

The input module 110 and the telescopic antenna 120 are electrically coupled to the switch circuit 130, and at the same time point, the switch circuit 130 electrically couples the telescopic antenna 120 to one of the satellite signal module 150 and the telecommunication transceiver module 140.

The telescopic antenna 120 may be a multi-segment antenna, which may be adjusted to a first length L1 and a second length L2. The telescopic antenna 120 may be extended to the first length L1 from the second length L2. Also, the telescopic antenna 120 may be retracted to the second length L2 from the first length L1.

The telecommunication transceiver module 140 transmits and receives a signal of a first frequency via the telescopic antenna 120 when the telescopic antenna 120 is extended to the first length L1. On the other hand, the telecommunication transceiver module 140 transmits and receives a signal of a second frequency via the telescopic antenna 120 when the telescopic antenna 120 is adjusted to the second length L2. The satellite signal module 150 receives a satellite signal via the telescopic antenna 120 when the telescopic antenna 120 is adjusted to the second length L2.

Figure 2:
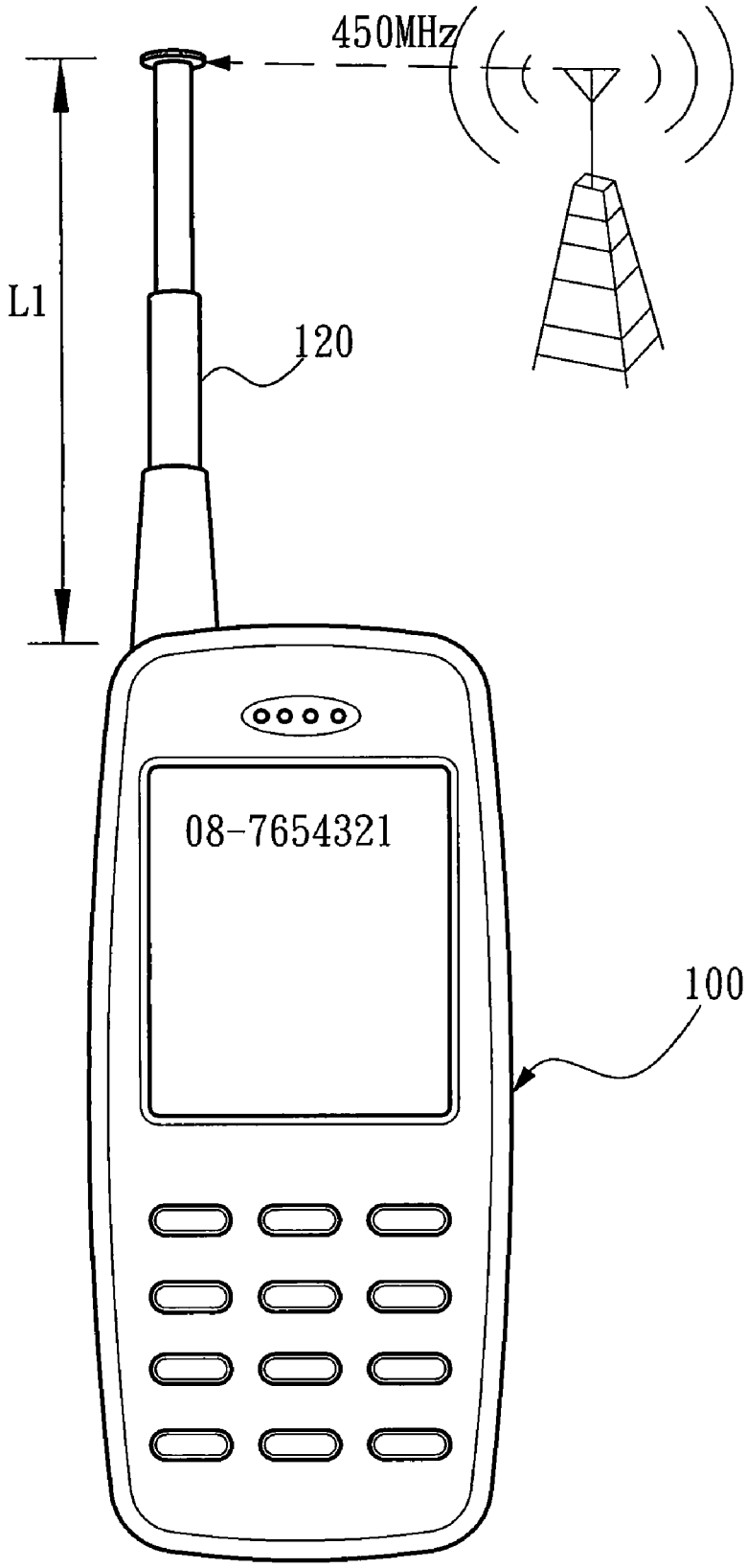
FIG. 2 shows an extended state of a telescopic antenna according to an embodiment of the present invention.

Referring to both FIGS. 1 and 2, when the telecommunication transceiver module 140 is electrically connected to the telescopic antenna 120 through the switch circuit 130, and the telescopic antenna 120 is extended to the first length L1, the signal of the first frequency transmitted and received by the telecommunication transceiver module 140 via the telescopic antenna 120 is a signal of a relatively low frequency, for example, a telecommunication signal with a frequency of 450 MHz.

Figure 3:
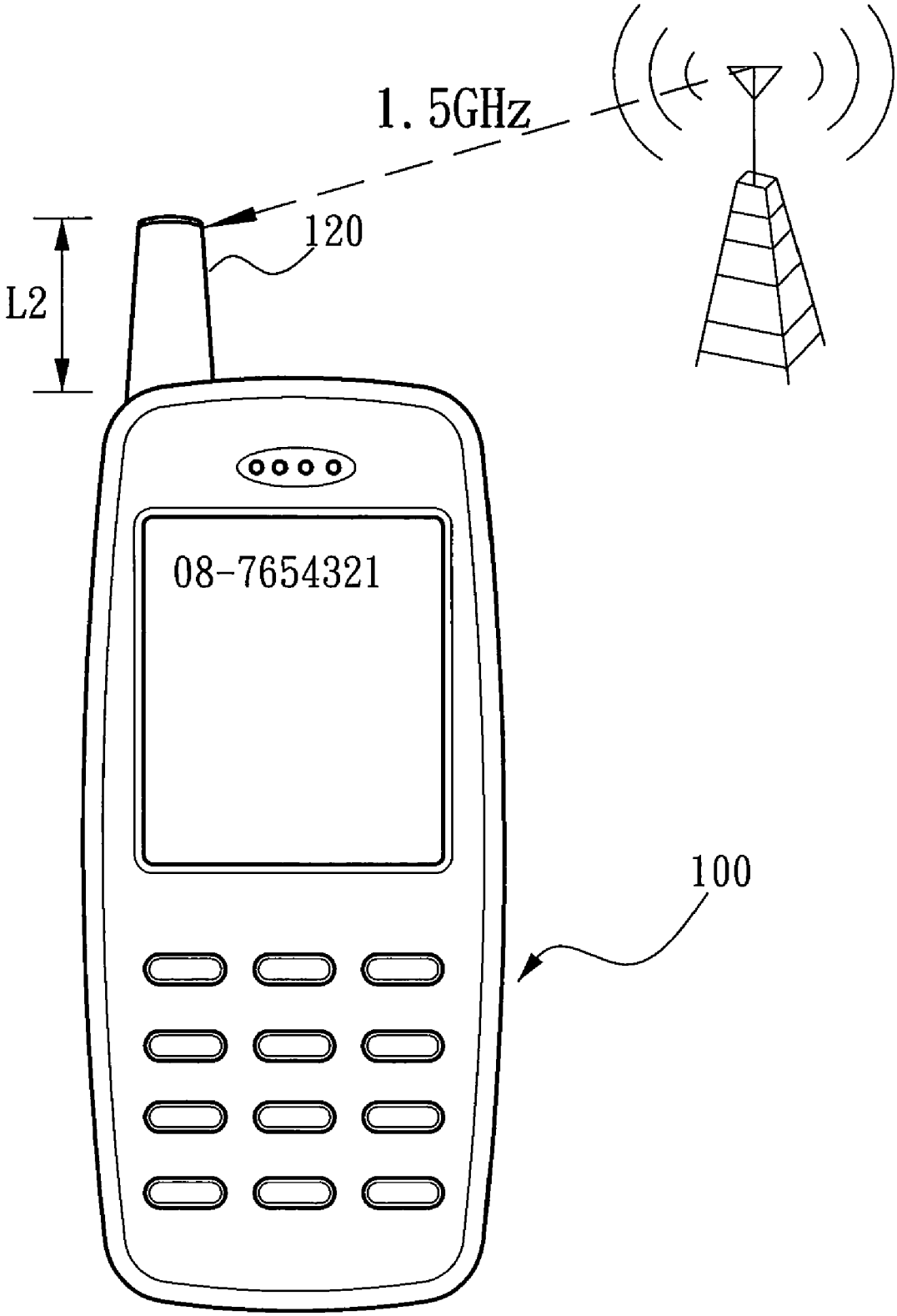
FIG. 3 shows a retracted state of a telescopic antenna according to an embodiment of the present invention.

Referring to both FIGS. 1 and 3, when the telecommunication transceiver module 140 is electrically connected to the telescopic antenna 120, and the telescopic antenna 120 is adjusted to the second length L2, the signal of the second frequency transmitted and received by the telecommunication transceiver module 140 via the telescopic antenna 120 is a signal of a relatively high frequency, for example, a telecommunication signal with a frequency of 1.5 GHz.

Figure 4:
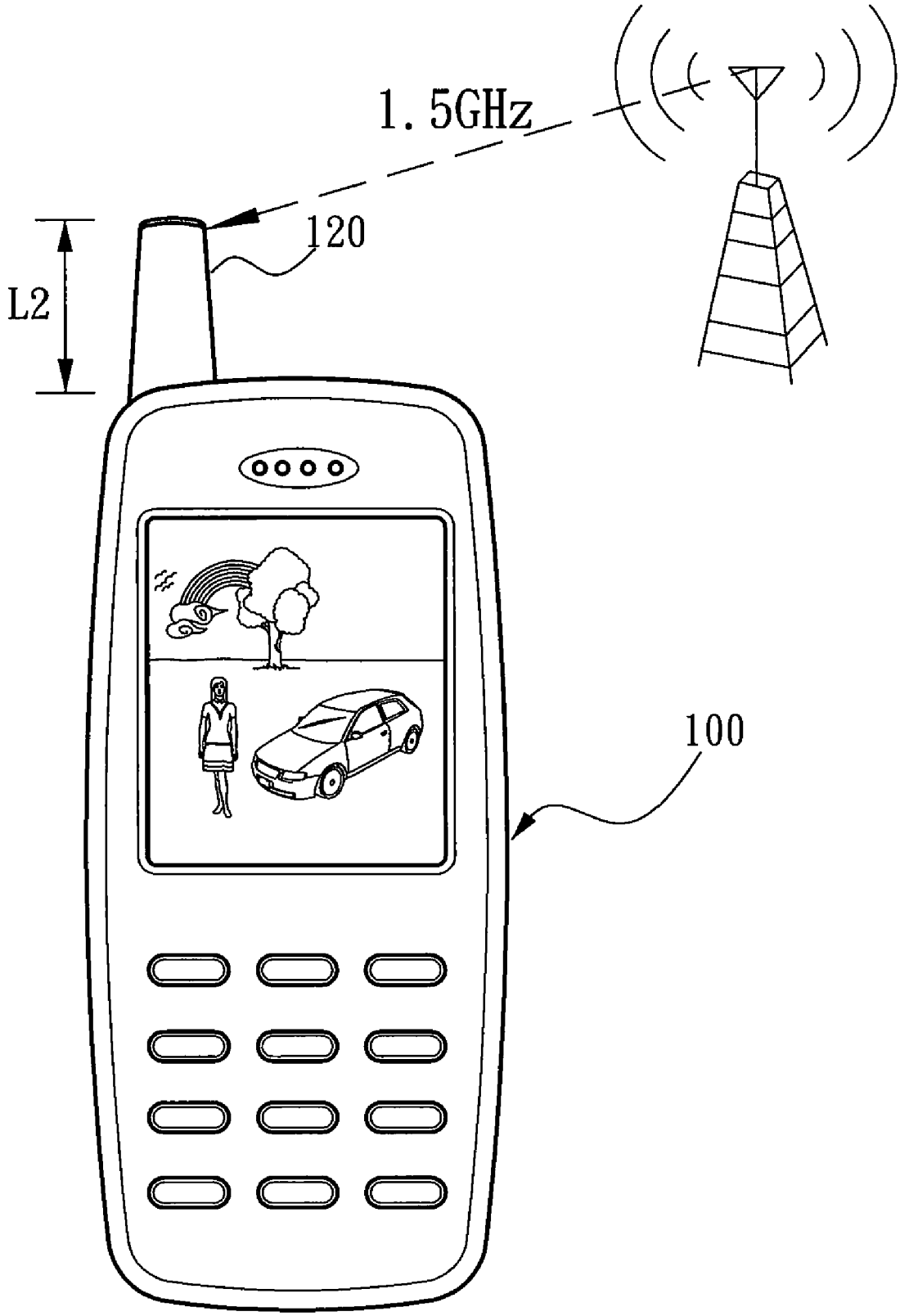
FIG. 4 is a satellite signal receiving view of an embodiment of the present invention.

Referring to both FIGS. 1 and 4, when the satellite signal module 150 is electrically connected to the telescopic antenna 120 through the switch circuit 130, and the telescopic antenna 120 is adjusted to the second length L2, the satellite signal transmitted and received by the satellite signal module 150 via the telescopic antenna 120 is a signal of a relatively high frequency, for example, a satellite signal used by the GPS or satellite TV with a frequency of 1.5 GHz or 2.5 GHz.

The input module 110 is adapted to input a switch signal to the switch circuit 130. The switch circuit 130 performs a circuit switching according to the current connecting circumstances among the telescopic antenna 120, the telecommunication transceiver module 140, and the satellite signal module 150.

For example, the telescopic antenna 120 is electrically coupled to the telecommunication transceiver module 140. When receiving a switch signal, the switch circuit 130 turns off a coupling circuit between the telescopic antenna 120 and the telecommunication transceiver module 140 and meanwhile electrically connects the telescopic antenna 120 to the satellite signal module 150. On the contrary, the switch circuit 130 turns off the coupling circuit between the telescopic antenna 120 and the satellite signal module 150 and meanwhile electrically connects the telescopic antenna 120 to the telecommunication transceiver module 140.

The switch signal includes control commands for adjusting the telescopic antenna 120 and functional modules to be switched, which includes the following manners.

Firstly, the control command of the switch signal is to switch to the telecommunication transceiver module 140 and transmit and receive signals of a relatively high frequency. The switch circuit 130 electrically couples the telescopic antenna 120 to the telecommunication transceiver module 140, adjusts the telescopic antenna 120 to the second length L2, and enables the telecommunication transceiver module 140 to transmit and receive a signal of a second frequency (e.g., 1.5 GHz) via the telescopic antenna 120.

Secondly, the control command of the switch signal is to switch to the telecommunication transceiver module 140 and transmit and receive signals of a relatively low frequency. The switch circuit 130 electrically couples the telescopic antenna 120 to the telecommunication transceiver module 140, adjusts the telescopic antenna 120 to the first length L1, and enables the telecommunication transceiver module 140 to transmit and receive a signal of a first frequency (e.g., 450 MHz) via the telescopic antenna 120.

Thirdly, the control command of the switch signal is to switch to the satellite signal module 150 and transmit and receive satellite signals. The switch circuit 130 electrically couples the telescopic antenna 120 to the satellite signal module 150, adjusts the telescopic antenna 120 to the second length L2, and enables the satellite signal module 150 to transmit and receive a satellite signal (e.g., 1.5 GHz or 2.5 GHz) via the telescopic antenna 120.

Figure 5:
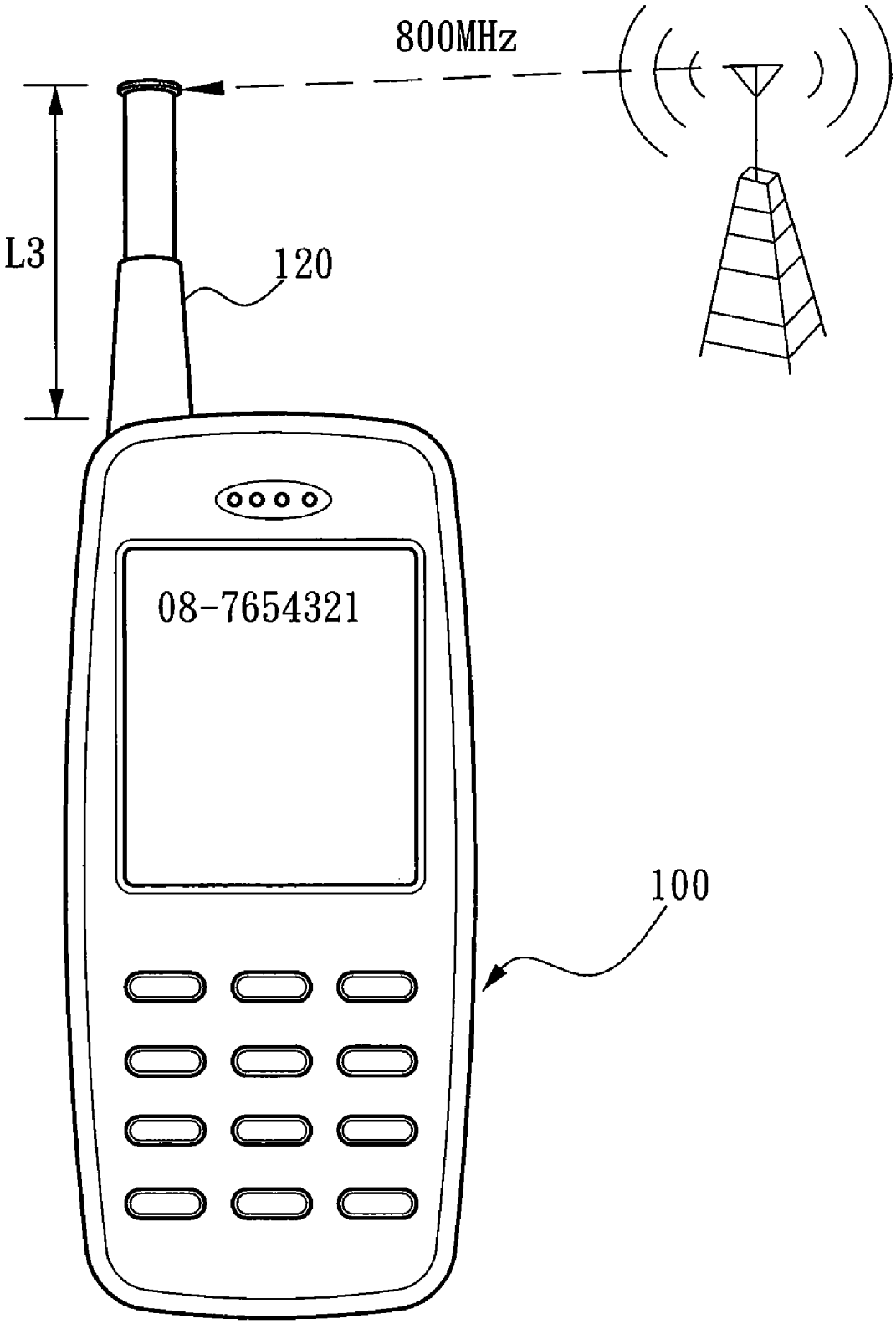
FIG. 5 shows an extended state of a telescopic antenna according to an embodiment of the present invention.

Referring to FIGS. 1 and 5, the telescopic antenna 120 is further adjusted to a third length L3, in which the third length L3 falls between the first length L1 and the second length L2, and correspondingly, the telecommunication transceiver module 140 transmits and receives a signal of a third frequency. Therefore, when the control command of the switch signal is to switch to the telecommunication transceiver module 140 and transmit and receive signals of frequencies which are higher than the first frequency that is relatively low and lower than the second frequency that is relatively high, the switch circuit 130 electrically couples the telescopic antenna 120 to the telecommunication transceiver module 140, adjusts the telescopic antenna 120 to the third length L3, and enables the telecommunication transceiver module 140 to transmit and receive a signal of a third frequency (e.g., a telecommunication signal with a frequency of 800 MHz) via the telescopic antenna 120.

The satellite signal module 150 is a global positioning module or a satellite TV module, or the satellite signal module 150 is integrated with a global positioning module or a satellite TV module.

FIG. 2 shows an adjusted state of a telescopic antenna according to an embodiment of the present invention. Referring to FIG. 2, in this embodiment, the telescopic antenna 120 is adjusted to the first length L1 for the telecommunication transceiver module 140 therein to transmit and receive a signal of a first frequency (e.g., a telecommunication signal with a frequency of 450 MHz).

FIG. 3 shows an adjusted state of a telescopic antenna according to an embodiment of the present invention. Referring to FIG. 3, in this embodiment, the telescopic antenna 120 is adjusted to the second length L2 for the telecommunication transceiver module 140 therein to transmit and receive a signal of a second frequency (e.g., a telecommunication signal with a frequency of 1.5 GHz).

FIG. 4 is a satellite signal receiving view of an embodiment of the present invention. Referring to FIG. 4, in this embodiment, the telescopic antenna 120 is adjusted to the second length L2 for the satellite signal module 150 therein to transmit and receive a satellite signal (e.g., a satellite signal with a frequency of 1.5 GHz or 2.5 GHz). The satellite signal module 150 may be a global positioning module or a satellite TV module for receiving satellite signals with positioning information or TV images, and displaying the positioning information or TV images on a screen of the handheld device 100.

FIG. 5 shows an adjusted state of a telescopic antenna according to an embodiment of the present invention. Referring to FIG. 5, in this embodiment, the telescopic antenna 120 is adjusted to the third length L3 for the telecommunication transceiver module 140 therein to transmit and receive a signal of a third frequency (e.g., a telecommunication signal with a frequency of 800 MHz).

The present invention has been particularly described with reference to the preferred embodiments, but is not limited hereby. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A handheld device with switchable signal receiving modes, comprising:

a telescopic antenna, for being adjusted to a first length and a second length;

a telecommunication transceiver module, for transmitting and receiving a signal of a first frequency via the telescopic antenna when the telescopic antenna is adjusted to the first length, and transmitting and receiving a signal of a second frequency via the telescopic antenna when the telescopic antenna is adjusted to the second length;

a satellite signal module, for receiving a satellite signal via the telescopic antenna when the telescopic antenna is adjusted to the second length; and a switch circuit, for receiving a switch signal, and electrically coupled to the telescopic antenna, wherein when the telecommunication transceiver module is electrically coupled to the telescopic antenna, the switch circuit adjusts the telescopic antenna to the first length for the telecommunication transceiver module to transmit and receive the signal of the first frequency, and adjusts the telescopic antenna to the second length for the telecommunication transceiver module to transmit and receive the signal of the second frequency, or the switch circuit electrically couples the telescopic antenna to the satellite signal module when receiving the switch signal, and adjusts the telescopic antenna to the second length for the satellite signal module to receive the satellite signal.

2. The handheld device with switchable signal receiving modes according to claim 1, wherein the telescopic antenna is electrically coupled to one of the satellite signal module and the telecommunication transceiver module.

3. The handheld device with switchable signal receiving modes according to claim 1, wherein a frequency of the signal of the second frequency received by the telecommunication transceiver module is higher than that of the signal of the first frequency.

4. The handheld device with switchable signal receiving modes according to claim 1, wherein a frequency of the signal of the first frequency received by the telecommunication transceiver module is 450 MHz.

5. The handheld device with switchable signal receiving modes according to claim 1, wherein a frequency of the signal of the second frequency received by the telecommunication transceiver module is 1.5 GHz.

6. The handheld device with switchable signal receiving modes according to claim 1, wherein a frequency of the satellite signal received by the satellite signal module is 1.5 GHz.

7. The handheld device with switchable signal receiving modes according to claim 1, wherein a frequency of the satellite signal received by the satellite signal module is 2.5 GHz.

8. The handheld device with switchable signal receiving modes according to claim 1, wherein the switch circuit electrically couples the telescopic antenna to the telecommunication transceiver module when receiving the switch signal, and adjusts the telescopic antenna to a third length for the telecommunication transceiver module to transmit and receive a signal of a third frequency.

9. The handheld device with switchable signal receiving modes according to claim 7, wherein a frequency of the signal of the third frequency received by the telecommunication transceiver module is 800 MHz.

10. The handheld device with switchable signal receiving modes according to claim 1, wherein the telescopic antenna is a multi-segment antenna.

11. The handheld device with switchable signal receiving modes according to claim 1, wherein the satellite signal module is a global positioning module.

12. The handheld device with switchable signal receiving modes according to claim 1, wherein the satellite signal module is a satellite TV module.

* * * * *